US005135261A

United States Patent [19]

Cusack et al.

[11] Patent Number: 5,135,261

[45] Date of Patent: Aug. 4, 1992

[54] INDEX TAB LABEL ASSEMBLY

[75] Inventors: Joyce M. Cusack, Chicago, Ill.; Allison S. Phillips, Pasadena, Calif.; Anahit Tataryan, Temple City, Calif.; Astgik Sinanyan, North Hollywood, Calif.

[73] Assignee: Avery Dennison Corporation, Pasadena, Calif.

[21] Appl. No.: 668,991

[22] Filed: Mar. 12, 1991

[51] Int. Cl.[5] ..... B42D 15/00

[52] U.S. Cl. ..... 285/81; 40/359; 40/641

[58] Field of Search ..... 283/81, 36, 38, 39, 283/41, 900, 71; 40/299, 359, 360, 641

[56] References Cited

U.S. PATENT DOCUMENTS

| | | | |
|---|---|---|---|
| 3,425,145 | 2/1969 | Newton . | |
| 4,580,815 | 4/1986 | Barber | 283/81 |
| 4,763,930 | 8/1988 | Matley . | |
| 4,872,706 | 10/1989 | Brewen et al. . | |
| 4,884,827 | 12/1989 | Kelley | 283/81 |

OTHER PUBLICATIONS

Catalog of Pifer Office Supply, Inc., 1988, pp. 225 and 243.

*Primary Examiner*—Timothy V. Eley
*Assistant Examiner*—Willmon Fridie, Jr.
*Attorney, Agent, or Firm*—Poms, Smith, Lande & Rose

[57] ABSTRACT

An index tab label assembly using a label having a coating that facilitates printing on the label. Each label is made out of a polyester film having a pressure-sensitive adhesive attached to one side of the film and a coating comprising aluminum oxide, resin chips, methyl ethyl ketone, and toluene, applied to the other side of the sheet. The coating provides good anchorage for toner, abrasive resistance for writing, and electrostatic properties that facilitate printing when using laser or xerographic equipment. The printed label is attached by the pressure-sensitive adhesive directly to a tab of a divider or file to make an index tab, or to a tab reinforcer attached to the tab.

20 Claims, 2 Drawing Sheets

FIG. 1
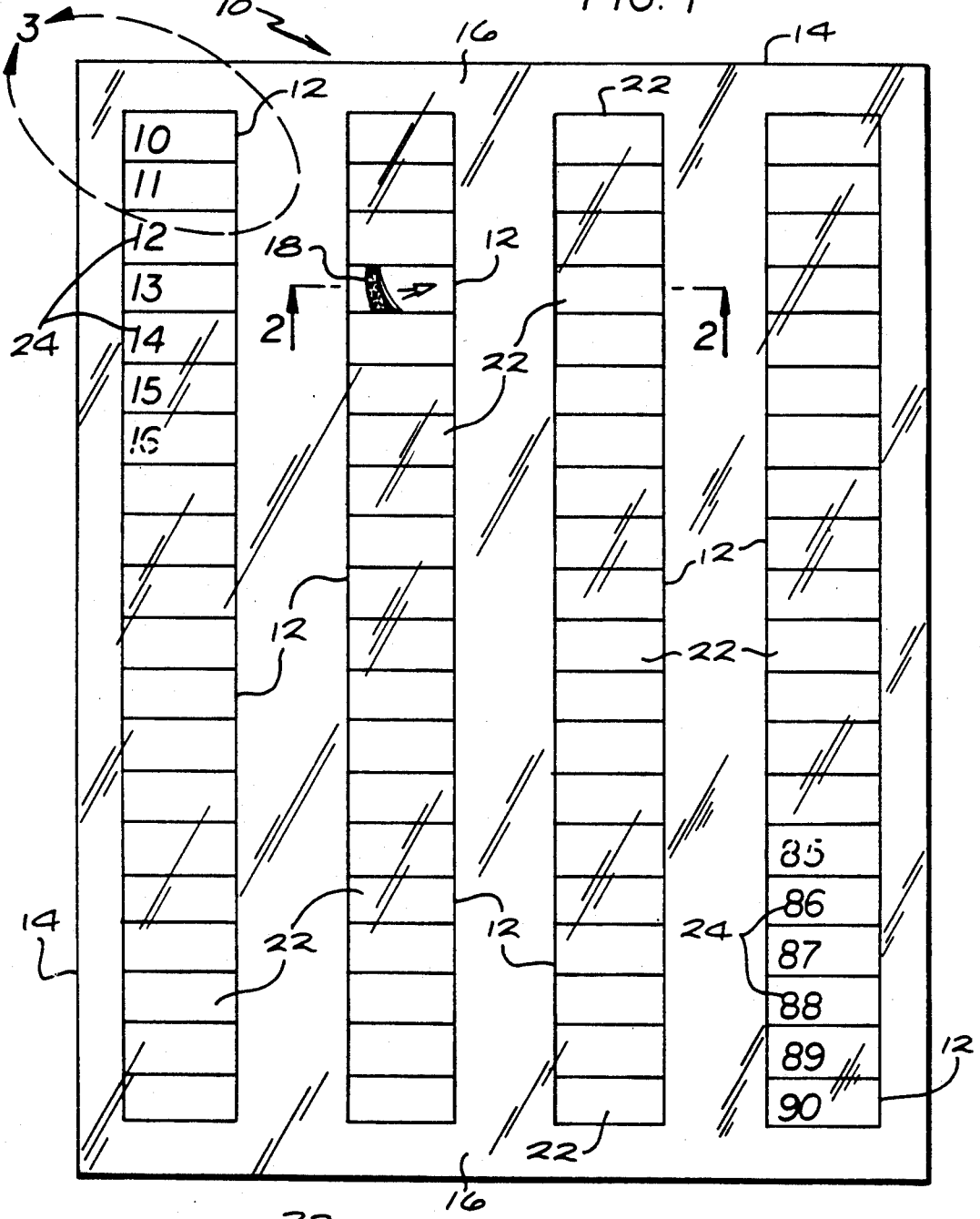
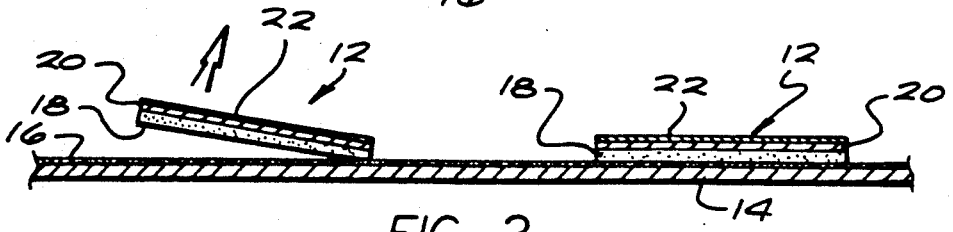
FIG. 2

INDEX TAB LABEL ASSEMBLY

BACKGROUND OF THE INVENTION

The present invention relates generally to labels and to index tabs used for notebooks, dividers, files, or the like, and, more particularly, to an index tab label assembly using a label having a coating that facilitates printing thereon. The label is preferably transparent and is attached by a pressure-sensitive adhesive directly to a tab of a divider or file to make an index tab, or to a tab reinforcer attached to the tab.

FIELD OF THE INVENTION

In the past, labels have been used for a variety of different purposes. For example, U.S. Pat. No. 4,872,706, issued to Brewen et al. on Oct. 10, 1989, discloses a postage advertising label having a print side onto which an advertisement can be printed and an adhesive side. A pressure sensitive adhesive may be used at the adhesive side to releasably secure the label to a backing member. The label is made out of a white opaque material. A postage stamp may be affixed to the print side of the label. Another label used on a bottle is described in U.S. Pat. No. 4,763,930, issued to Matney on Aug. 16, 1988. The label is precut from a clear cellulose acetate sheet. The back side of the label is first printed with a transparent light-colored material providing indicia, and then coated with a pressure sensitive adhesive. A white opaque material is printed on the front side of the label, and then overprinted with a black bar code.

U.S. Pat. No. 3,425,145, issued to Newton on February 4, 1969, describes an index tab reinforced by a laminate consisting of Mylar and polyethylene layers of material. Indicia on the underlying tab may be seen through the transparent laminate materials.

In the past, clear self-adhesive labels have been releasably attached to backing sheets. Transparent self-adhesive label protectors releasably attached to backing sheets are described on Page 225 of the 1988 Catalog of Pifer Office Supply, Inc.

SUMMARY OF THE INVENTION

One problem associated with the use of index dividers and file folder index tabs is that the index tabs are difficult to read and assemble, and often have a very poor appearance as well as a short lifetime under normal busy office usage conditions.

Accordingly, a broad object of the invention is to overcome the above-identified problems. There is a need for an index tab label assembly having a label that a person may easily print indicia on using laser or other printing equipment, and then use to make an index tab for a divider, file, or the like.

It is an object of this invention to provide an index tab label assembly having a label that a person may print indicia on using laser or other printing equipment.

It is another object of this invention to provide an index tab label assembly having a label that may be used to make an index tab for a divider, file, or the like.

It is still another object of this invention to provide an index tab label assembly that is easy to use and economical to fabricate.

These and other objects and advantages are attained in accordance with one specific illustrative embodiment of an index tab label assembly using a label having a coating that facilitates printing on the label. Each label is made out of a polyester film having a pressure-sensitive adhesive attached to one side of the film and a coating comprising aluminum oxide, PE 200 resin chips, methyl ethyl ketone, and toluene, applied to the other side of the sheet. The coating provides good anchorage for toner, abrasive resistance for writing, and electrostatic properties that facilitate printing when using laser or xerographic equipment. The printed label is attached by the pressure-sensitive adhesive directly to a tab of a divider or file to make an index tab, or to a tab reinforcer attached to the tab.

In accordance with a broader aspect of the invention, an index tab label assembly is provided using a label with a coating that facilitates printing indicia on the label. The label is made out of a thin film having the coating applied to one side and an adhesive applied to the other side. The index tab label assembly is formed by attaching the label to a tab of a divider or a file using the adhesive.

The various features of the present invention will be best understood together with further objects and advantages by reference to the following description of the preferred embodiments taken in conjunction with the accompanying drawings.

BRIEF DESCRIPTION OF THE DRAWINGS

FIG. 1 is a front elevational view showing a plurality of labels releasably attached to a backing sheet;

FIG. 2 is a cross-sectional view taken in the direction of arrows 2-2 shown in FIG. 1;

DESCRIPTION OF THE PREFERRED EMBODIMENTS

The following specification taken in conjunction with the drawings sets forth the preferred embodiments of the present invention in such a manner that any person skilled in the art can make and use the invention. The embodiments of the invention disclosed herein are the best modes contemplated by the inventors for carrying out their invention in a commercial environment although it should be understood that various modifications can be accomplished within the parameters of the present invention.

Figure 3:
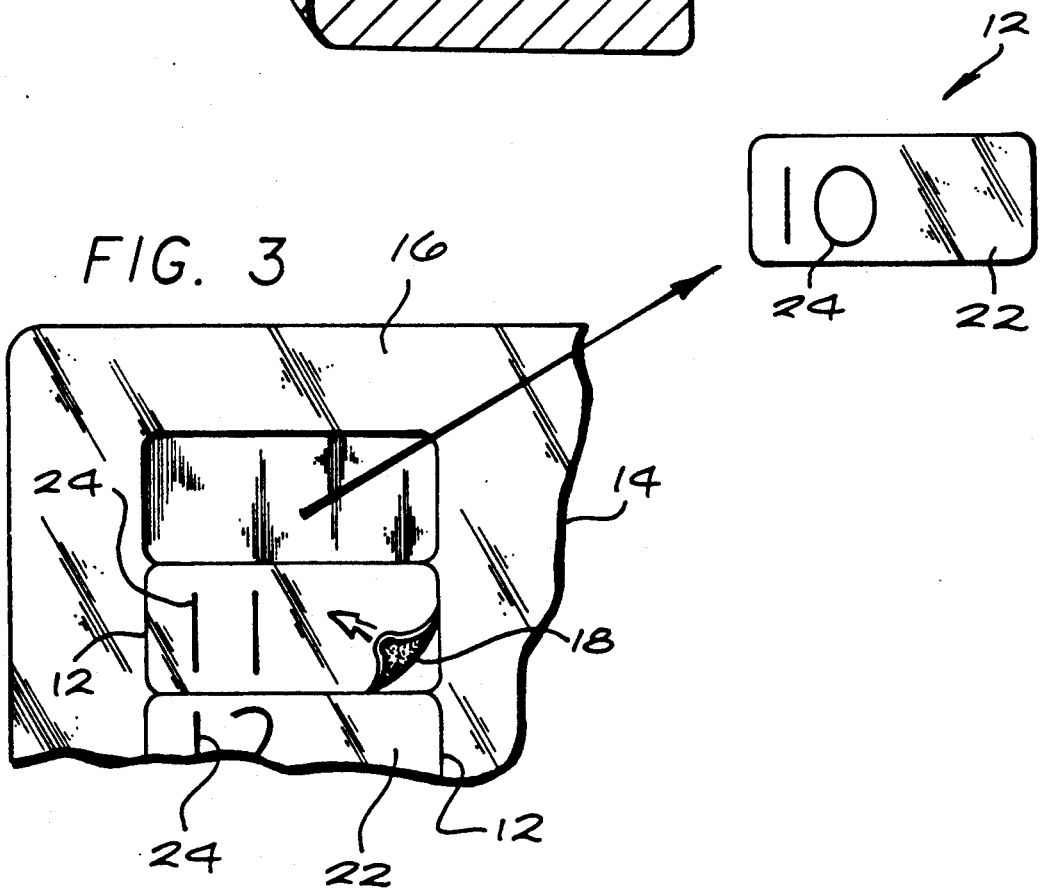
FIG. 3 is an enlarged detailed view of some of the labels of FIG. 1 showing one of the labels removed from the backing sheet.

FIGS. 1 through 3 show a label product 10 having a plurality of labels 12 releasably attached to a backing sheet 14. The backing sheet 14 is preferably made out of 03870-45#MF bleached paper sold by James River Corporation. However, any paper or plastic material may be used for sheet 14. The sheet 14 and labels 12 may be easily sent through laser or other printing equipment.

The backing sheet 14 preferably has a silicone release coating 16 on one side thereof that facilitates peeling labels 12 off the sheet 14 as discussed below. Alternatively, fluorinated or amine-based release coatings 16 may be used, or any other desirable coating 16. The release coating 16 is preferably formed of conventional silicone material which has a negligible thickness in the order of a few ten thousands of an inch.

The plurality of labels 12 are releasably attached to backing sheet 14 by a stable, pressure-sensitive adhesive 18 of a type which will not flow at a temperature of a few hundred degrees Fahrenheit. However, it is preferred that the pressure-sensitive adhesive 18 will remain stable when subjected to , temperatures in the range of up to about 300 to about 400 degrees Fahrenheit to facilitate printing on the labels 12 through laser or other high temperature printing equipment as discussed below.

The adhesive 18 may be P09 acrylic adhesive sold by Avery Dennison Corporation, or a rubber based adhesive of styrene butadiene and ABA block copolymers compounded with tackifying resins. However, it is important to note that any suitable stable, pressure-sensitive adhesive 18 may be used which facilitates printing at high temperatures, peeling from the backing sheet 14, and adhering the labels 12 to an index tab as discussed below.

As best shown in FIG. 2, each label 12 has a film with a thickness preferably in a range of from about 1.42 mils to about 3.0 mils. However, any desirable thickness may be used for the film 20. The film 20 is preferably transparent and made from 142 gauge matte-finish Hostaphan 2000 series film marketed by Hoechst Celanese. However, any desirable polyester may be used for the film 20 such as Mylar, or the like.

The adhesive 18 is attached to one side of each film 20 (used for each label 12), and a coating 22 is applied to the other side of the film 20. The coating 2 is used to facilitate printing on the label 12 (or film 20) using laser or other printing techniques (such as xerographic printing). As such, the coating 22 provides good anchorage for toner and abrasive resistance for writing on the labels 12.

The coating 22 preferably comprises aluminum oxide ($Al_2O_3$), PE 200 resin chips sold by Goodyear, methyl ethyl ketone, and toluene. By weight, this composition preferably comprises aluminum oxide (14.3 parts), PE 200 resin chips (18.7 parts), methyl ethyl ketone (33.5 parts), and toluene (33.5 parts). However, the composition by weight of the coating 22 may be varied as desired. The resin chips dissolve and the aluminum oxide disperses in the methyl ethyl ketone resulting in a very dispersed aluminum oxide and a coating 22 that is transparent and provides a milky tone, or a white background for printing. The thickness of the coating 22 preferably has a range of from about 0.01 mil to about 0.03 mil. However, any desirable thickness may be used for the coating 22. It is important to note that the coating 22 gives the polyester film 20 desirable electrostatic properties. Such properties facilitate printing on the labels 12 by laser or electrostatic printing.

The labels 12 may be releasably attached to the backing sheet 14 in rows as shown in FIG. 1. When so configured, the label product 10 may be easily fed through laser or other printing equipment so that indicia 24 such as numbers, letters, designs, or the like, may be printed on the labels 12. The labels 12 may then be peeled off the backing sheet 14 and used in a variety of different ways.

Figure 4:
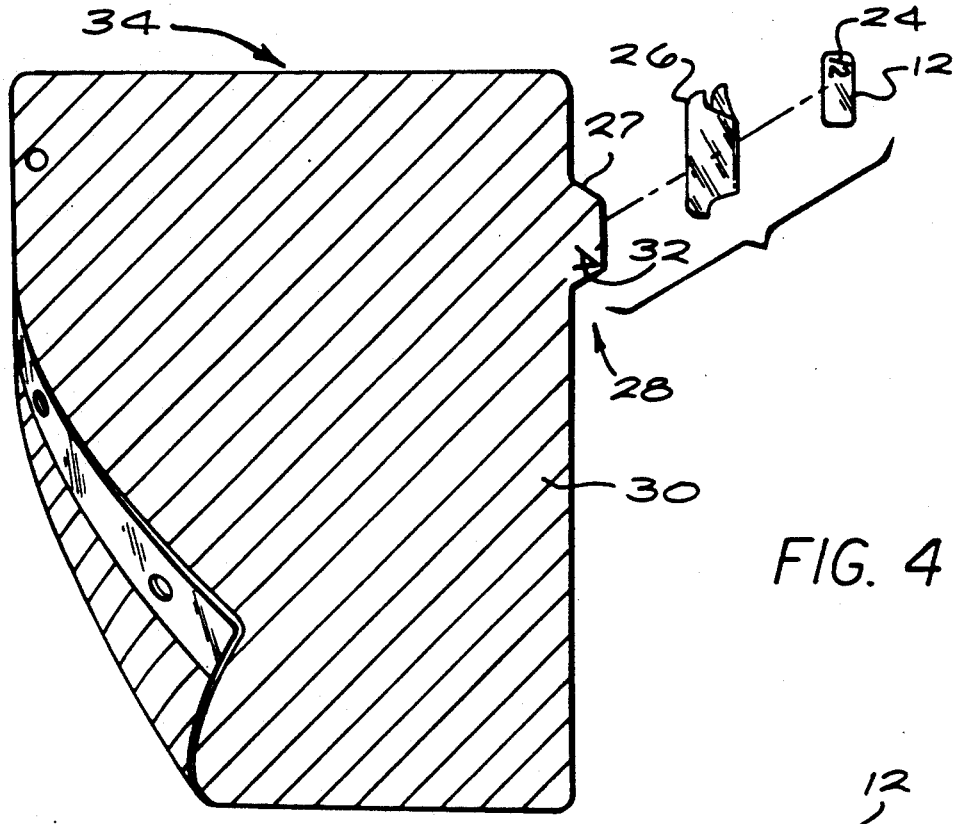
FIG. 4 is a front elevational view of an index tab label assembly showing how one of the labels of FIG. 1 may be used with a tab reinforcer to make an index tab (label and reinforcer shown in exploded view).

FIG. 4 shows how one of the labels 12 may be used with a tab reinforcer 26 to make an index tab 28 on a sheet 30 of an index tab label assembly. The sheet 30 may be made out of any type of paper, plastic material, or other suitable mater.

After indicia 24 is printed on the label 12, it may be easily peeled from the backing sheet 14 due to release coating 16. The label 12 may then be attached to the tab reinforcer 26 using the pressure-sensitive adhesive 18. The tab reinforcer 26 is then attached to a tab 27 of the divider sheet 30 using any suitable means such as adhesive, or the like, forming index tab 28. As discussed above, label 12 is preferably transparent. If tab reinforcer 26 is also made out of a transparent material such as plastic, then indicia 32 can be seen through label 12 and reinforcer 26 so that indicia 24 and 32 may be used together for the purpose of marking or identifying index tab 28. Moreover if tab 27 is colored, then the color of tab 27 will be visible through label 12 and reinforcer 26 and may be used with indicia 24 and 32 to further identify tab 28.

Alternatively, one of the labels 12 may be attached by the pressure-sensitive adhesive 18 directly to tab 27 in order to make the index tab 28. This eliminates the need for the tab reinforcer 26, resulting in a more economical assembly 34. However, if a reinforced index tab 28 is desired, then the tab reinforcer 26 should be used as described above. The index tab 28 may be used for notebooks, dividers, files, or the like.

It is important to note that the pressure-sensitive adhesive 18 may be chosen to allow the label 12 to be peeled off the tab 27, or tab reinforcer 26, and replaced with another label 12, if desired. However, adhesive 18 will keep the label 12 permanently attached to the tab 27 or tab reinforcer 26, if a new label is not needed.

The above description discloses the preferred embodiments of the present invention. However, persons of ordinary skill in the art are capable of numerous modifications once taught these principles. For instance, by way of example and not limitation, different sizes or shapes of labels 12 may be used. In addition, the tab reinforcer 26 or the film 20 used for the labels 12 may be opaque rather than transparent. Accordingly, it will be understood by those skilled in the art that changes in form and details may be made to the above-described embodiments without departing from the spirit and scope of the invention.

We claim:

1. An index tab label assembly comprising:
a sheet having a tab; and
a label attached to said tab forming an index tab, said label including:
(a) a thin film,
(b) an adhesive applied to one side of said film attaching said label to said tab, and
(c) coating means applied to the other side of said film for facilitating printing indicia on said label by providing anchorage for printing material, desirable electrostatic properties to facilitate laser and electrostatic printing, abrasive resistance for writing, and a background for enhancing said indicia, said coating means comprising aluminum oxide, resin, methyl ethyl ketone and toluene.

2. The assembly of claim 1 wherein said label is transparent.

3. The assembly of claim 2 wherein said thin film comprises polyester.

4. The assembly of claim 3 wherein said polyester is Mylar.

5. The assembly of claim 4 wherein said thin film has a thickness in a range of from about 1.42 mils to about 3.0 mils.

6. The assembly of claim 2 wherein said adhesive is a stable, pressure-sensitive adhesive.

7. The assembly of claim 6 wherein said stable, pressure-sensitive adhesive is not activated by a temperature of up to about 400 degrees Fahrenheit.

8. The assembly of claim 1 wherein said coating means comprises by weight 14.3 parts aluminum oxide, 18.7 parts resin chips, 33.5 parts methyl ethyl ketone and 33.5 parts toluene.

9. The assembly of claim 8 wherein said coating means has a thickness in a range of from about 0.01 mil about 0.03 mil.

10. The assembly of claim 1 wherein said sheet is made out of relatively stiff paper or cardboard.

11. The assembly of claim 10 wherein said sheet is a divider.

12. The assembly of claim 10 wherein said sheet forms part of a file folder.

13. An index tab label assembly comprising:

a sheet having a tab;

a tab reinforcer attached to said tab;

a label attached to said tab reinforcer, said label including:

(a) a thin film, (b) an adhesive applied to one side of said film, said adhesive attaching said label to said tab reinforcer, and (c) coating means applied to the other side of said film for facilitating printing indicia on said label by providing anchorage for printing material, desirable electrostatic properties to facilitate laser and electrostatic printing, abrasive resistance for writing, and a background for enhancing said indicia, said coating means comprising aluminum oxide, resin, methyl ethyl ketone and toluene.

14. The assembly of claim 13 wherein said film comprises polyester.

15. The assembly of claim 14 wherein said adhesive is a stable, pressure-sensitive adhesive.

16. An index tab label assembly comprising:

a sheet having a tab;

a tab reinforcer attached to said tab; and a label attached to said tab reinforcer, said label including:

(a) a thin polyester film, (b) an adhesive applied to one side of said film, said adhesive attaching said label to said tab reinforcer, and (c) transparent coating means applied to the other side of said film for facilitating printing indicia on said label by providing anchorage for printing material, desirable electrostatic properties to facilitate laser and electrostatic printing, abrasive resistance for writing, and a background for enhancing said indicia, said coating means comprising aluminum oxide, resin, methyl ethyl ketone and toluene.

17. The assembly of claim 16 wherein said adhesive is a stable, pressure-sensitive adhesive.

18. The assembly of claim 17, wherein said stable, pressure-sensitive adhesive is not activated by a temperature of up to about 400 degrees Fahrenheit.

19. The assembly of claim 16 wherein said coating means has a thickness in a range of from about 0.01 mil to about 0.03 mil.

20. An index tab label assembly comprising:

a sheet having an integral tab;

a tab reinforcer attached to said tab;

a label attached to said tab reinforcer, said label including:

(a) a transparent thin film, (b) an adhesive applied to one side of said film, said adhesive attaching said label to said tab reinforcer, and (c) transparent coating means applied to the other side of said film for facilitating printing indicia on said label by providing anchorage for printing material, desirable electrostatic properties to facilitate laser and electrostatic printing, abrasive resistance for writing, and a background for enhancing said indicia;

whereby said assembly may have visible identification both on said integral tab and on said transparent label.

* * * * *